US009879896B2

(12) United States Patent
Koo

(10) Patent No.: US 9,879,896 B2
(45) Date of Patent: Jan. 30, 2018

(54) ICE MAKING SYSTEM AND METHOD FOR A REFRIGERATOR

(71) Applicant: Dongbu Daewoo Electronics Corporation, Seoul (KR)

(72) Inventor: Min Bon Koo, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 147 days.

(21) Appl. No.: 14/836,854

(22) Filed: Aug. 26, 2015

(65) Prior Publication Data

US 2016/0370078 A1 Dec. 22, 2016

(30) Foreign Application Priority Data

Jun. 16, 2015 (KR) ..... 10-2015-0085389

(51) Int. Cl.

| | |
|---|---|
| ***F25C 1/00*** | (2006.01) |
| ***F25C 5/18*** | (2006.01) |
| ***F25C 5/00*** | (2006.01) |
| ***F25D 23/02*** | (2006.01) |

(52) U.S. Cl.

CPC ..... *F25C 5/182* (2013.01); *F25C 5/005* (2013.01); *F25D 23/028* (2013.01); *F25C 2400/10* (2013.01); *F25D 2317/061* (2013.01); *F25D 2317/062* (2013.01); *F25D 2317/063* (2013.01); *F25D 2317/0671* (2013.01)

(58) Field of Classification Search

CPC ..... F25C 1/00; F25C 5/005
USPC ..... 62/66, 340, 344, 441, 449
See application file for complete search history.

(56) References Cited

U.S. PATENT DOCUMENTS

| | | | | |
|---|---|---|---|---|
| 2,993,347 | A * | 7/1961 | Muffly | F25B 49/02 62/159 |
| 3,568,465 | A | 3/1971 | Jung | |
| 8,434,322 | B2 | 5/2013 | Lee et al. | |
| 2005/0210909 | A1 | 9/2005 | Kim et al. | |
| 2005/0252232 | A1 * | 11/2005 | Lee | F25D 17/065 62/340 |
| 2010/0011796 | A1 | 1/2010 | Lee | |
| 2010/0096887 | A1 * | 4/2010 | Mori | B62D 21/152 296/203.02 |
| 2010/0101260 | A1 | 4/2010 | Lee et al. | |
| 2010/0326096 | A1 | 12/2010 | Junge et al. | |

(Continued)

FOREIGN PATENT DOCUMENTS

| | | | |
|---|---|---|---|
| KR | 10-2000-0034758 | A | 6/2000 |
| KR | 10-2005-0094673 | A | 9/2005 |

(Continued)

OTHER PUBLICATIONS

Extended European Search Report dated Nov. 15, 2016 issued in corresponding European Patent Application No. 15186857.7.

*Primary Examiner* — Melvin Jones

(57) ABSTRACT

Ice making system and method for a refrigerator is disclosed. The ice making system includes an ice making unit that makes ice cubes, a cold air generator that cools air inside a cooling duct so as to produce cold air, a cold air circulation unit that supplies the cold air from the cold air generator to the ice making unit, and discharges the cold air from the ice making unit to the cold air generator, and a cold air guiding unit that circulates the cold air inside the ice making unit.

17 Claims, 7 Drawing Sheets

(56) References Cited

U.S. PATENT DOCUMENTS

2011/0011118 A1* 1/2011 Cho ..... F25D 17/065
62/419
2013/0167576 A1 7/2013 Kim et al.

FOREIGN PATENT DOCUMENTS

KR 10-2005-0098135 10/2005
KR 10-2006-0039169 A 5/2006

* cited by examiner

ICE MAKING SYSTEM AND METHOD FOR A REFRIGERATOR

CROSS-REFERENCE TO RELATED APPLICATIONS

The present application claims priority to and the benefit of the Republic of Korea Patent Application Serial Number 10-2015-0085389, having a filing date of Jun. 16, 2015, filed in the Korean Intellectual Property Office, the disclosure of which is herein incorporated by reference in its entirety.

FIELD OF THE INVENTION

The present invention relates to an ice maker for refrigerators and a method for manufacturing the same.

BACKGROUND

A refrigerator unit is an apparatus intended to store food items at low temperatures. The refrigerator unit may store foods in a frozen or refrigerated state according to the type of food intended to be stored.

The interior of the refrigerator unit is cooled by cold air that is constantly supplied. The cold air is constantly generated through a heat exchanging operation with a refrigerant based on a refrigeration cycle. The cycle includes a process of compression-condensation-expansion-evaporation that are sequentially performed. The cold air supplied to the inside of the refrigerator unit is evenly transferred by convection to store food, drink, and other items within the refrigerator unit at desired temperatures.

In general, a main body of the refrigerator unit has a rectangular, hexahedral shape which is open at a front surface. The front surface may provide access to a refrigeration compartment and a freezer compartment located within the body of the refrigerator unit. Further, hinged doors may be fitted to the front side of the refrigerator body in order to selectively open and/or close openings to the refrigeration compartment and the freezer compartment. In addition, a number of drawers, racks, shelves, storage boxes, and the like may be provided in the refrigeration compartment and the freezer compartment within the refrigerator unit that are configured for optimally storing various foods, drinks, and other items within a storage space inside the refrigerator unit.

Conventionally, refrigerator units were configured as a top mount type in which a freezer compartment is positioned above a refrigeration compartment. Recently, bottom freezer type refrigerator units position the freezer compartment below the refrigeration compartment to enhance user convenience. In the bottom freezer type refrigerator unit, the more frequently used refrigeration compartment is advantageously positioned at the top so that a user may conveniently access the compartment without bending over at the waist, as previously required by the top mount type refrigerator unit. The less frequently used freezer compartment is positioned at the bottom.

However, a bottom freezer type refrigerator unit may lose its design benefits when a user wants to access the lower freezer compartment on a more frequent basis. For example, prepared ice that is stored in the freezer compartment may be a popular item accessed frequently by a particular user. In a bottom freezer type refrigerator unit, since the freezer compartment is positioned below the refrigeration compartment, the user would have to bend over at the waist in order to open the freezer compartment door to access the ice.

In order to solve such a problem, bottom freezer type refrigerators may include a dispenser configured for dispensing ice that is provided in a refrigeration compartment door. In this case, the ice dispenser is also positioned in the upper portion of the refrigerator unit, and more specifically is located above the freezer compartment. In this case, an ice maker for generating ice may be provided in the refrigeration compartment door or in the interior of the refrigeration compartment.

For example, in a bottom freezer type refrigerator having an ice making device in the refrigeration compartment door, cold air that has been produced by an evaporator is divided and discharged both into the freezer compartment and into the refrigeration compartment. Here, cold air that was discharged into the freezer compartment flows to the ice making device via a cold air supply duct arranged in a sidewall of the body of the refrigerator unit, and then freezes water while circulating inside the ice making device. Thereafter, the cold air is discharged from the ice making device into the refrigeration compartment via a cold air restoration duct arranged in the sidewall of the body of the refrigerator unit, so the cold air can reduce the temperature inside the refrigeration compartment.

However, when the cold air of the freezer compartment is introduced into the ice making device via the cold air supply duct, a large amount of cold air may be discharged from the ice making device into the refrigeration compartment via the cold air restoration duct without being used to make ice cubes. This may reduce the efficiency of the ice making device, and negatively affect the overall performance of the ice making device and/or the refrigerator unit.

What is needed is an efficient way to make ice within a refrigerator unit.

SUMMARY

In view of the above, therefore, embodiments of the present invention provide an ice making system and method for a refrigerator unit in which cold air produced from a cooling duct can efficiently circulate through an ice making unit.

In accordance with one embodiment of the present invention, there is provided an ice making system for a refrigerator unit. The ice making system may include an ice making unit that makes ice cubes; a cold air generator that cools air inside a cooling duct so as to produce cold air; a cold air circulation unit that supplies the cold air from the cold air generator to the ice making unit, and discharges the cold air from the ice making unit to return to the cold air generator; and a cold air guiding unit that circulates the cold air inside the ice making unit.

Exemplary embodiments of the present invention are advantageous in that the cold air can efficiently circulate inside an ice making unit while branching. In that manner, embodiments of the present invention are capable of supplying a larger amount of cold air to an ice making space rather than to an ice storage space.

Another advantage of exemplary embodiments of the present invention include a refrigerator unit that is capable of preventing cold air from being prematurely discharged from an ice making unit to a cooling duct without first being used to make ice cubes. This increases the performance and efficiency of the ice making unit when operating to make ice.

A further advantage of exemplary embodiments of the present invention include the ability for an ice making unit to make ice cubes using the cold air directly produced from the cooling duct. This increases the efficiency of efficiency of the ice making unit when making ice, and also increases the efficiency of generating and supplying cold air from the cold air generator.

Still another advantage of exemplary embodiments of the present invention include a refrigerator unit that is capable of circulating cold air a short distance within an ice making space defined between a cooling duct and a refrigeration compartment door. The distance the cold air travels is relatively shorter than the conventional technique in which cold air is produced from a lower part of a bottom freezer type refrigerator flows to an ice making space defined in a refrigeration compartment door. As a result, embodiments of the present invention can reduce the loss of cold air by significantly reducing the distance the cold air travels before it is used to make ice, thereby making the ice making unit more efficient. This increase in efficiency of the ice making unit allows the refrigerator unit to save electricity during its operation.

In accordance with another embodiment of the present invention, a method of manufacturing ice is disclosed, and includes cooling air using a cooling duct so as to produce cold air; supplying the cold air to an ice making unit so as to make ice cubes; circulating the cold air in the ice making unit; discharging the cold air from the ice making unit to the cooling duct; and cooling the discharged cold air again in the cooling duct.

In accordance with another embodiment, a refrigerator is disclosed and includes a freezer compartment located within a main body of the refrigerator, and a refrigeration compartment located within the main body of the refrigerator, wherein the freezer compartment is located below the refrigeration compartment. The refrigerator includes an ice making unit that makes ice cubes; a cold air generator that cools air inside a cooling duct so as to produce cold air; a cold air circulation unit that supplies the cold air from the cold air generator to the ice making unit and discharges the cold air from the ice making unit to the cold air generator; and a cold air guiding unit that circulates the cold air inside the ice making unit.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, functions, constituents, procedures, and components have not been described in detail so as not to unnecessarily obscure aspects and/or features of the present disclosure.

Figure 1:
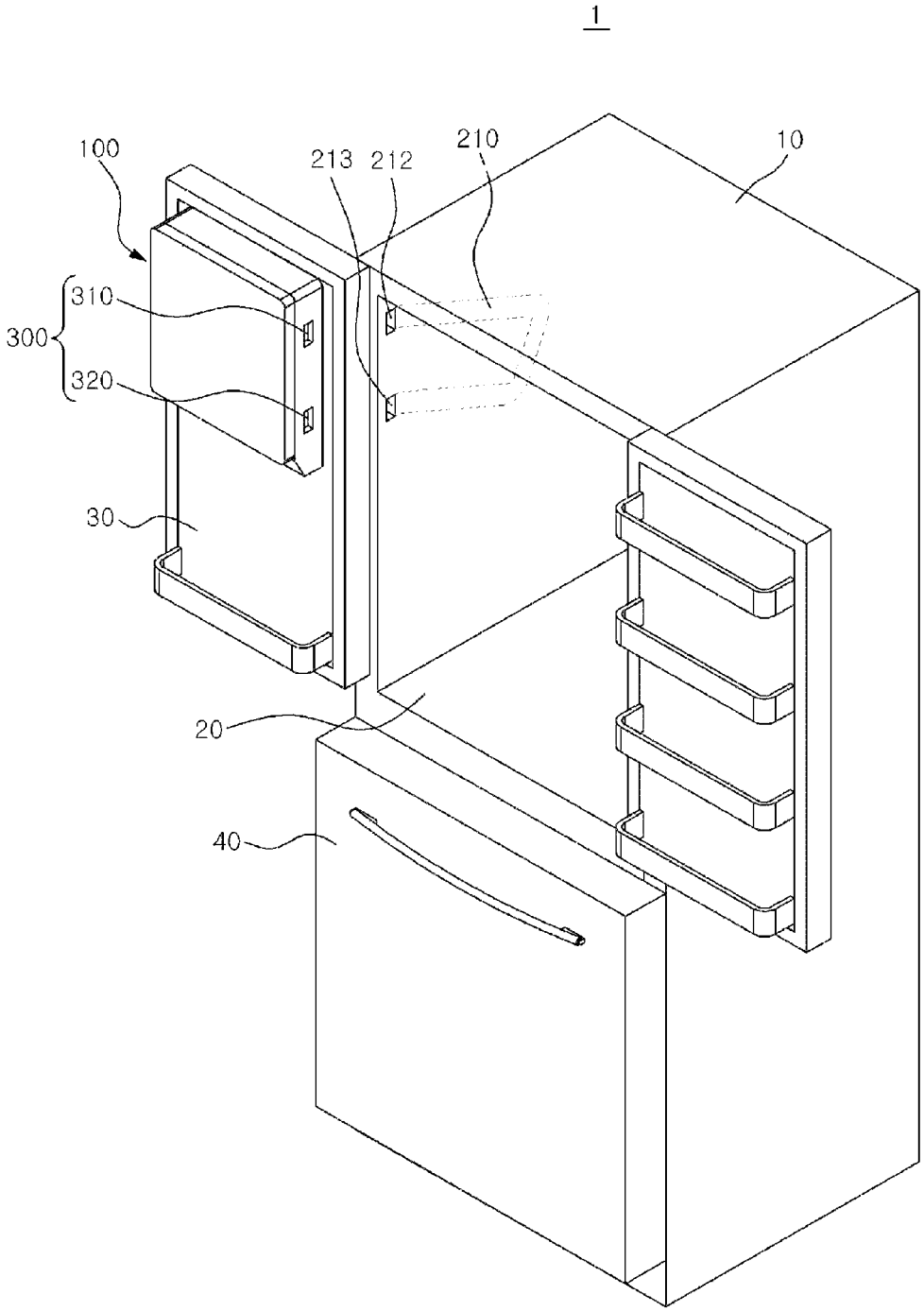
FIG. 1 is a perspective view of a refrigerator unit showing an ice making system, in accordance with one embodiment of the present disclosure.
Figure 2:
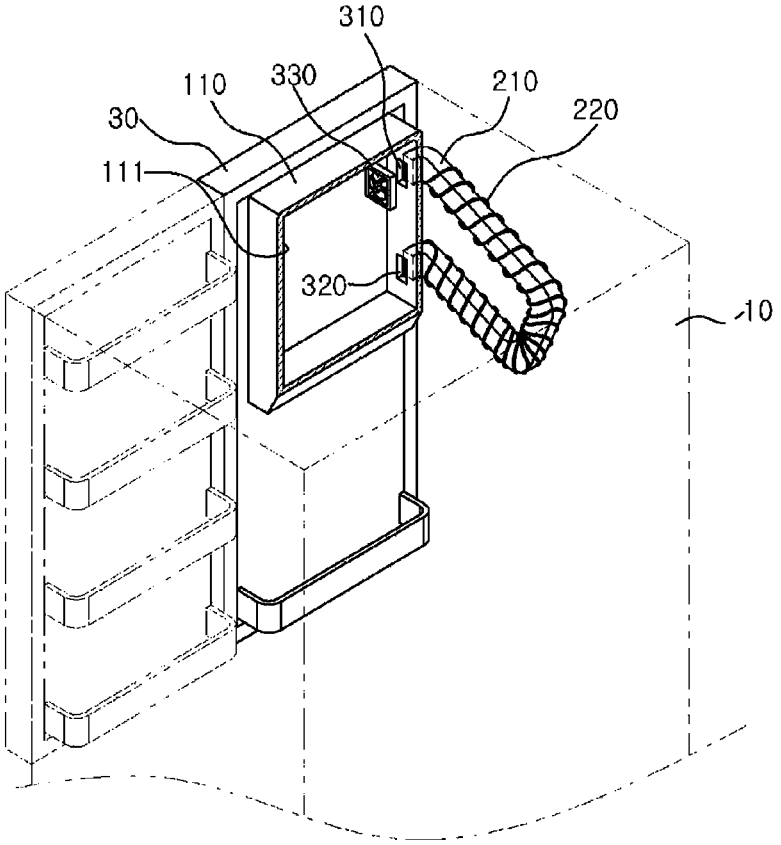
FIG. 2 is a view showing a connection between an ice making unit and a cooling duct of a cold air generator in the ice making system for a refrigerator unit, in accordance with one embodiment of the present disclosure.
Figure 3:
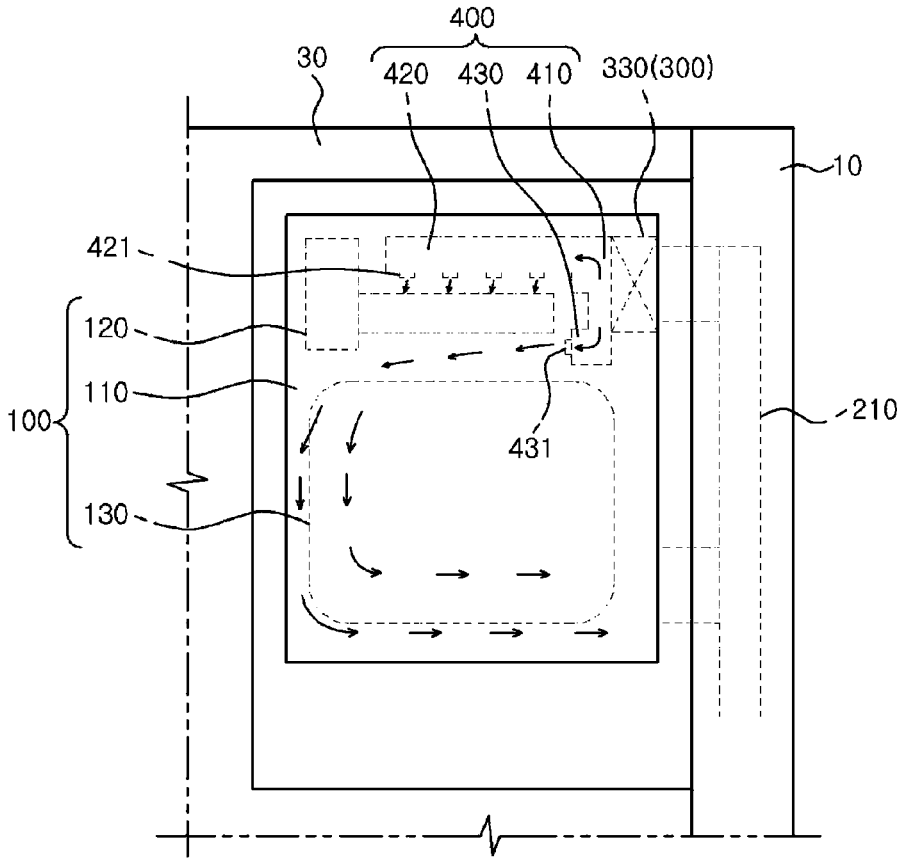
FIG. 3 is a cross-sectional view showing an internal construction of an ice making system for a refrigerator unit, in accordance with one embodiment of the present disclosure.

FIG. 1 is a perspective view showing an ice making system for a refrigerator unit, in accordance with one embodiment of the present disclosure. FIG. 2 is a view showing a connection between an ice making unit and a cooling duct of a cold air generator in the ice making system for the refrigerator unit of FIG. 1, in accordance with one embodiment of the present disclosure. FIG. 3 is a cross-sectional view showing an internal construction of an ice making system for the refrigerator unit of FIG. 1, in accordance with one embodiment of the present disclosure.

As shown in FIGS. 1 to 3, the ice making system for the refrigerator unit according to exemplary embodiments of the present invention can efficiently circulate cold air produced from a cooling duct 210 inside an ice making cabinet 110 of the ice making unit 100.

Here, the refrigerator unit 1 may include a refrigerator body 10 that defines an external appearance or exterior. A barrier 20 is configured for dividing the interior cavity of the refrigerator body 10 into a refrigeration compartment at the top thereof, and a freezer compartment at the bottom thereof. One or more doors may be configured to selectively isolate the interiors of the compartments from the surrounding environment. For example, a pair of refrigeration compartment doors 30 may be hinged to opposite edges of the front of the refrigeration compartment, and are configured through rotation thereof to selectively open and close the refrigeration compartment.

Although the refrigerator 1 of the exemplary embodiments of the present invention is a bottom freezer type refrigerator in which the freezer compartment is provided in the lower part of the refrigerator body, it should be understood that the present invention may be adapted to various types of refrigerators without being limited to the bottom freezer type refrigerator The ice making system of the present invention includes an ice making unit 100, a cold air generator 200, a cold air circulation unit 300, and a cold air guiding unit 400.

Described in detail, the ice making unit 100 changes the phase of water to ice using cold air. The ice making unit may be provided on an inner surface of the refrigeration compartment door 30. Although the ice making unit 100 of the present embodiment is provided on the upper part or portion of the refrigeration compartment door 30, the location is provided merely for illustration purposes only. It should be understood that the ice making unit 100 may be provided on another position of the refrigeration compartment door 30, in a different position within the interior of the refrigeration compartment, and the like.

The ice making unit 100 may include an ice making cabinet 110, an ice maker 120, and an ice bank 130.

Here, the ice making cabinet 110 may be provided on the inside surface of the refrigeration compartment door 30, and may define an ice making space 111 in which ice cubes are produced. The ice maker 120 can freeze water using cold air flowing into the ice making space 111, such as when making ice cubes. The ice maker 120 can discharge the ice cubes into the ice bank 130. The ice bank 130 is provided at a location below the ice maker 120 and is configured to receive ice cubes discharged from the ice maker 120. The ice bank 130 can store the ice cubes discharged from the ice maker 120, and can dispense ice cubes to users using an ice dispenser unit (not shown).

The cold air circulation unit 300 functions to introduce cold air from the cold air generator 200 into the ice making space 111 of the ice making unit 100. The cold air circulation unit 300 is also configured to discharge the cold air from the ice making space 111 to the cold air generator 200, to undergo a new refrigeration cycle.

For example, the cold air circulation unit 300 may include an inlet hole 310 provided on an upper part of the ice making unit 100 and an outlet hole provided on a lower part of the ice making unit 100. The inlet hole 310 in the ice making unit 100 may be provided at a location corresponding to a first duct hole 212 of the cooling duct 210. The outlet hole 320 may be provided at a location corresponding to a second duct hole 213 of the cooling duct 210. A circulation fan 330 may be configured to circulate cold air from the inlet hole 310 to the outlet hole 320 through the ice making unit 100.

In particular, the cooling duct 210 is provided in the refrigerator body 10, and the ice making unit 100 is provided on the refrigeration compartment door 30 of the refrigerator unit 1. As such, when the refrigeration compartment door 30 is closed onto the refrigerator body 10, the first duct hole 212 of cooling duct 210 may be aligned with the inlet hole 310 of the ice making unit 100, and the second duct hole 213 of cooling duct 210 may be aligned with the outlet hole 320 of the ice making unit 100.

Further, when the refrigeration compartment door 30 is closed onto the refrigerator body 10, the cold air inside the cooling duct 210 flows into the inlet hole 310 of the ice making unit 100 via the first duct hole 212. In the ice making unit 100, the cold air introduced from the cooling duct 210 circulates inside the ice making space 111 by the operation of the circulation fan 330. In that manner, water inside the ice making space 111 gradually freezes, and given enough refrigeration cycles ice cubes may be formed. Thereafter, the cold air inside the ice making unit 100 is discharged into the second duct hole 213 of the cooling duct 210 via the outlet hole 320. The cold air discharged from the ice making unit 100 is cooled again inside the cooling duct 210, and via the first duct hole 212 being reintroduced into the inlet hole 310 of the ice making unit 100.

The cold air guiding unit 400 may guide the flow of the cold air such that the cold air can circulate inside the ice making unit 100 while branching. The cold air guiding unit 400 may be provided at a position in front of the inlet hole 310 through which the cold air flows into the ice making space 111. Described in detail, the cold air guiding unit 400 may be provided at a position in front of the circulation fan 330.

The cold air guiding unit 400 may include a main guide 410 that introduces the cold air from the cooling duct 210 into the cold air guiding unit 400. A first sub-guide 420 extends upward from the main guide 410 so as to guide the cold air upward to a position above the ice maker 120 of the ice making unit 100. A second sub-guide 430 extends downward from the main guide 410 so as to guide the cold air downward to a position below the ice maker 120 of the ice making unit 100. Here, the first sub-guide 420 is provided with a plurality of first guide holes 421 that discharges the cold air over water contained in an ice making tray (not shown) of the ice maker 120. The second sub-guide 430 is provided with a second guide hole 431 that discharges the cold air to a position below the ice making tray.

Thus, the first sub-guide 420 is configured to guide a portion of the cold air collected inside the main guide 410 to a position above the ice maker 120. The second sub-guide 430 can guide a remaining portion of the cold air collected inside the main guide 410 to a position below the ice maker 120.

In other words, the cold air that has been introduced into the cold air guiding unit 400 branches towards positions above and below the ice maker 120 via the first sub-guide 420 and the second sub-guide 430. In that manner, cold air can efficiently cool the upper and lower parts of the ice cubes produced by the ice maker 120. After passing through the ice maker 120, the cold air flows along the inner surface of the ice making cabinet 110, thus being efficiently discharged from the ice making cabinet 110 via the outlet hole 220.

Figure 4:
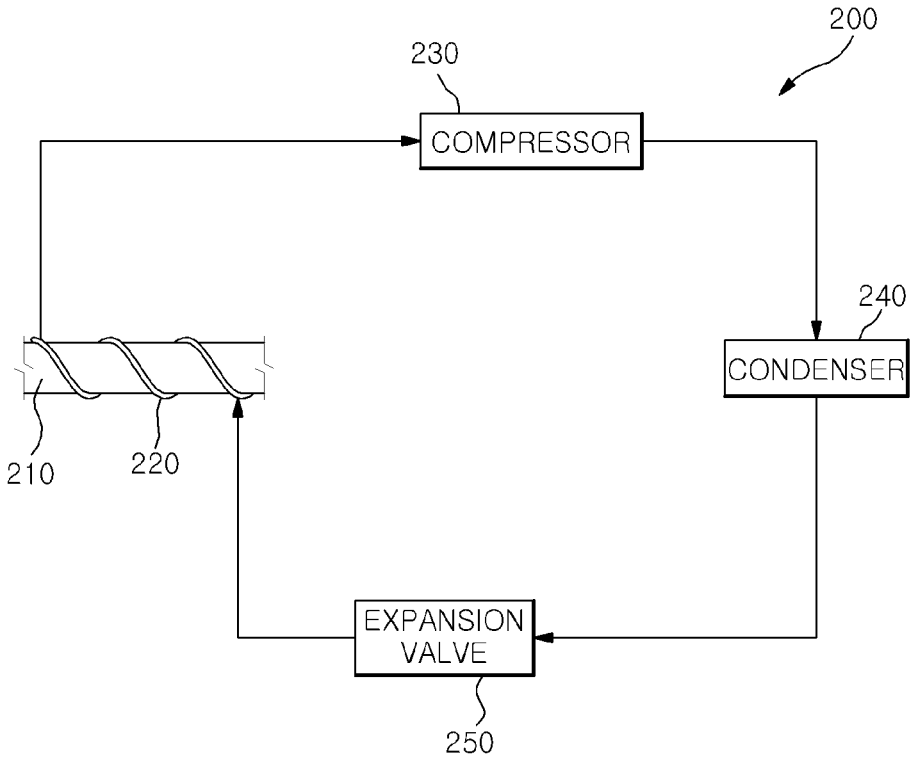
FIG. 4 is a block diagram illustrating a refrigeration cycle of a cold air generator of an ice making system for a refrigerator unit, in accordance with one embodiment of the present disclosure.

FIG. 4 is a block diagram showing the construction of the cold air generator 200 of the ice making system for the refrigerator unit 1, in accordance with one embodiment of the present disclosure.

As shown in FIG. 4, the cold air generator 200 can cool air flowing through the cooling duct 210, thereby producing cold air. The cold air generator 200 can supply the cold air to the ice making unit 100. The cold air generator 200 may be provided inside the refrigerator body 10 of the refrigerator unit 1. More specifically, the cold air generator 200 may be provided on the sidewall of the refrigerator body 10, in one embodiment. In another embodiment, the cold air generator 200 may be provided in the lower part of the refrigerator body 10.

The cold air generator 200 includes the cooling duct 210 that is provided in the sidewall of the refrigerator body. The cooling duct is configured to form a cooling line through which air flows. An evaporation coil 220 is configured to be wound around the cooling duct 210, such that the air inside and traveling through the cooling duct is cooled by a heat exchanging operation between the air and a refrigerant. A compressor 230 is configured to compresses the refrigerant discharged from the evaporation coil 220 so as to change the refrigerant to a high temperature and high pressure vapor or gas refrigerant. A condenser 240 is configured to condense the gas refrigerant so as to change the gas refrigerant to a high pressure liquid refrigerant. An expansion valve 250 is configured to perform adiabatic expansion of the liquid refrigerant, and supplies the liquid refrigerant to the evaporation coil 220.

The first duct hole 212 may be provided on the upper end of the cooling duct 210, such that the first duct hole 212 can communicate with, or is connected to, the inlet hole 310 of the ice making unit 100 when the refrigeration compartment door 30 is closed. The second duct hole 213 may be provided on the lower end of the cooling duct 210, such that the second duct hole 213 can communicate with, or is connected to, the outlet hole 320 of the ice making unit 100 when the refrigeration compartment door 30 is closed.

In some embodiments, the compressor 230, the condenser 240, the expansion valve 250, and the evaporation coil 220 are configured to implement a refrigeration cycle for the purpose of supplying cold air. The refrigeration cycle composed of four processes (e.g., compression, condensation, expansion, and evaporation) is performed in which a heat exchanging operation between air and refrigerant is implemented. Accordingly, air inside the cooling duct 210 may be cooled to become cold air by a heat exchanging operation performed, in part, between the air inside the cooling duct 210 and the refrigerant inside the evaporation coil 220. In particular, the evaporation coil 220 cools the cooling duct 210 through heat conduction. Further, the cooling channel defined by and within the cooling duct 210 is sufficiently long such that air inside the cooling line can be efficiently cooled. That is, when the air flows through the cooling line for a predetermined period of time (dependent in part on the length of and flow of air through the cooling duct 210), the air can be cooled to a predetermined temperature (for example, 14 degrees Fahrenheit below zero or lower) at which the cold air can efficiently make ice cubes.

Accordingly, the refrigerant may be used in a refrigeration cycle performed by the evaporation coil 220, the compressor 230, the condenser 240, and the expansion valve 250. In that manner, the refrigerant may cool the air in the cooling duct, thereby supplying cold air to the ice making unit 100.

Although the compressor 230, the condenser 240, and the expansion valve 250 in the exemplary embodiment of the present invention form a refrigeration cycle that can be implemented to supply cold air to the ice making unit 100, other embodiments are well suited to supporting a refrigeration cycle that may supply cold air to both the refrigeration compartment and the freezer compartment of a refrigerator unit. In still another embodiment, the compressor 230, the condenser 240, and the expansion valve 250 may use the refrigerant used in an evaporator (not shown) to supply cold air to both the refrigeration compartment and the freezer compartment.

Figure 5:
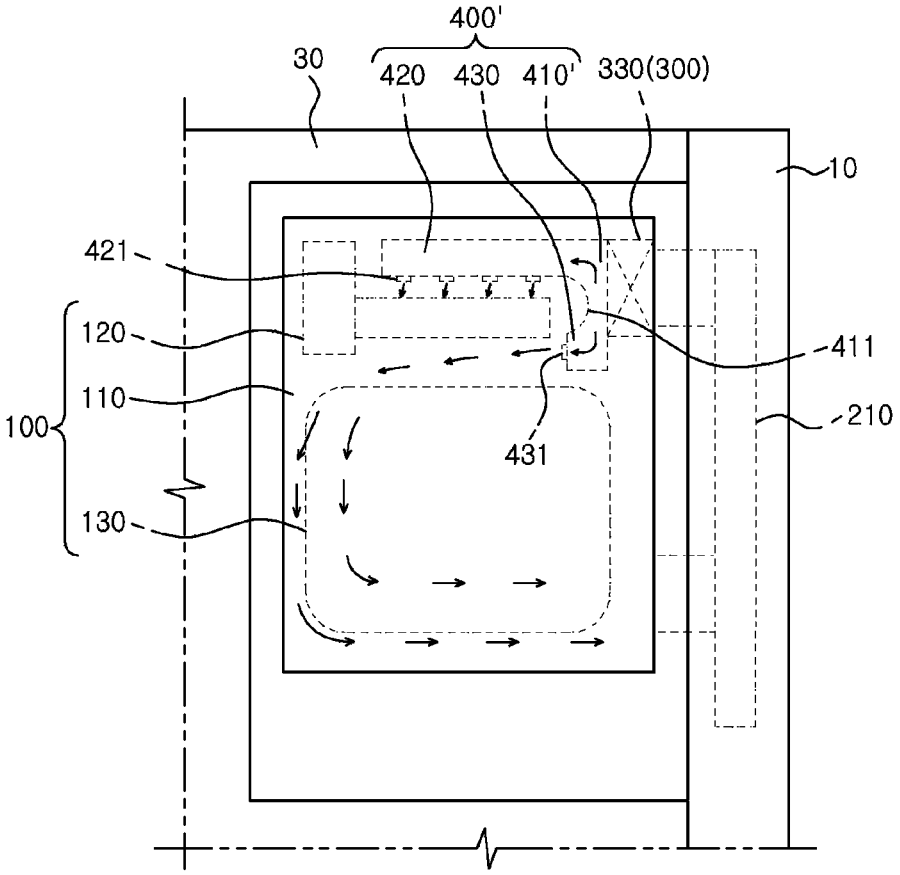
FIG. 5 is a cross-sectional view showing another internal construction of an ice making system for a refrigerator unit, in accordance with one embodiment of the present disclosure.

FIG. 5 is a cross-sectional view showing another internal construction of an ice making system for a refrigerator unit, in accordance with one embodiment of the present disclosure. The internal construction of the ice making system of FIG. 5 is different than the internal construction of the ice making system of FIG. 3. Similarly numbered elements in FIGS. 3 and 5 perform essentially the same functionality.

As shown in FIG. 5, a cold air guiding unit 400' is configured such that cold air flowing from the cooling duct 210 can more efficiently flow to branches due to the presence of a round surface 411.

For example, inside the main guide 410' of the cold air guiding unit 400', a round surface 411 is provided at a branching point from which the first sub-guide 420 and the second sub-guide 430 branch from each other. The round surface 411 can minimize frictional contact of cold air inside the cold air guiding unit 400'. In that manner, the cold air can more efficiently flow inside the cold air guiding unit 400', for example when compared to a flat surface at the branching point of the cold air guiding unit 400 of FIG. 3.

Figure 6:
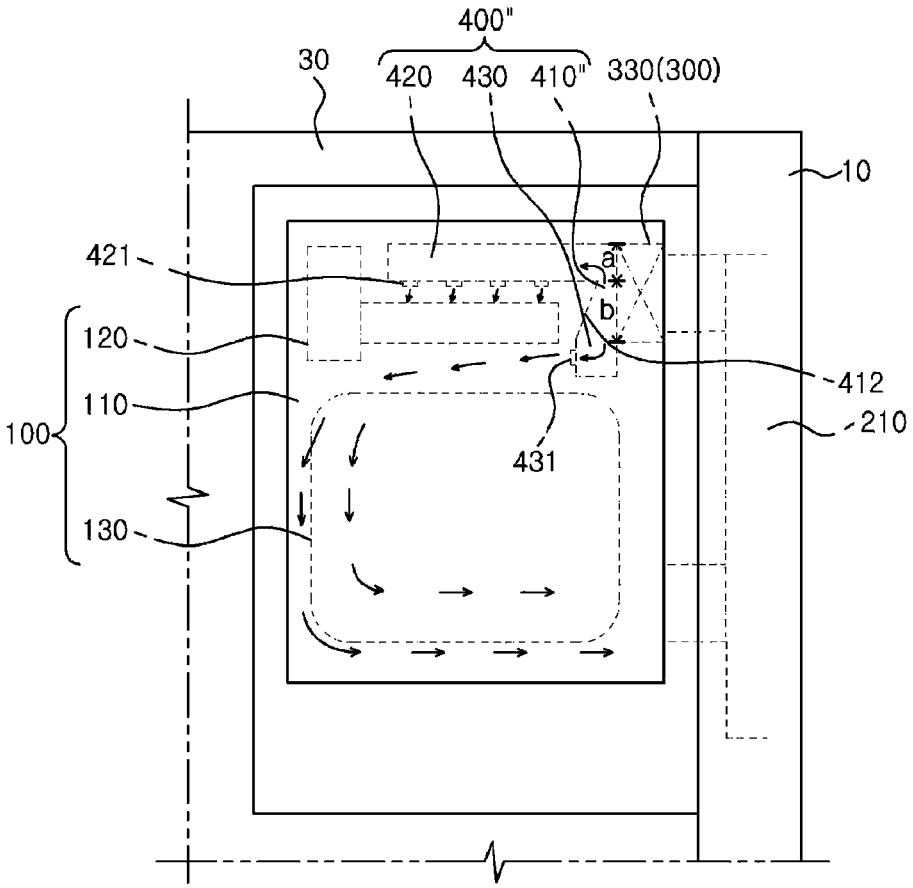
FIG. 6 is a cross-sectional view showing still another internal construction of an ice making system for a refrigerator unit, in accordance with one embodiment of the present disclosure.

FIG. 6 is a view showing still another internal construction of an ice making system for a refrigerator, in accordance with one embodiment of the present disclosure. The internal construction of the ice making system of FIG. 6 is different than the internal construction of the ice making system of FIG. 3, and is different than the internal construction of the ice making system of FIG. 5. However, each of the ice making systems in FIGS. 3, 5, and 6 are implementable within the refrigerator unit 1 of FIG. 1. Similarly numbered elements in FIGS. 3, 5, and 6 perform essentially the same functionality As shown in FIG. 6, a cold air guiding unit 400" is configured such that when cold air flows from the cooling duct 210 into the cold air guiding unit 400" the guide unit 400" can control the amounts of cold air guided to the first sub-guide 420 and the second sub-guide 430. In particular, to control the amounts of cold air guided to the first sub-guide 420 and the second sub-guide 430, an inclined surface 412 is provided in the guide unit 400".

For example, when the inclined surface 412 is inclined towards the second sub-guide 430 by a surface area of "b" as shown in FIG. 6, the cold air flowing from the cooling duct 210 may be guided to the second sub-guide 430 by an amount corresponding to the surface area of "b". Also, the cold air flowing from the cooling duct 210 may be guided to the first sub-guide 420 by an amount corresponding to a surface area of "a".

More specifically, the direction of inclination of the inclined surface 412 in the cold air guiding unit 400" is configured such that the amount of cold air guided to the second sub-guide 430 is greater than the amount of cold air guided to the first sub-guide 420. In that manner, the cold air can circulate in the ice making cabinet 110 in a direction in which the cold air is discharged from the second sub-guide 430. However, it should be understood that the direction of inclination of the inclined surface 411 in the cold air guiding unit 400" may be freely changed as desired without being limited to the embodiment shown in FIG. 6

Figure 7:
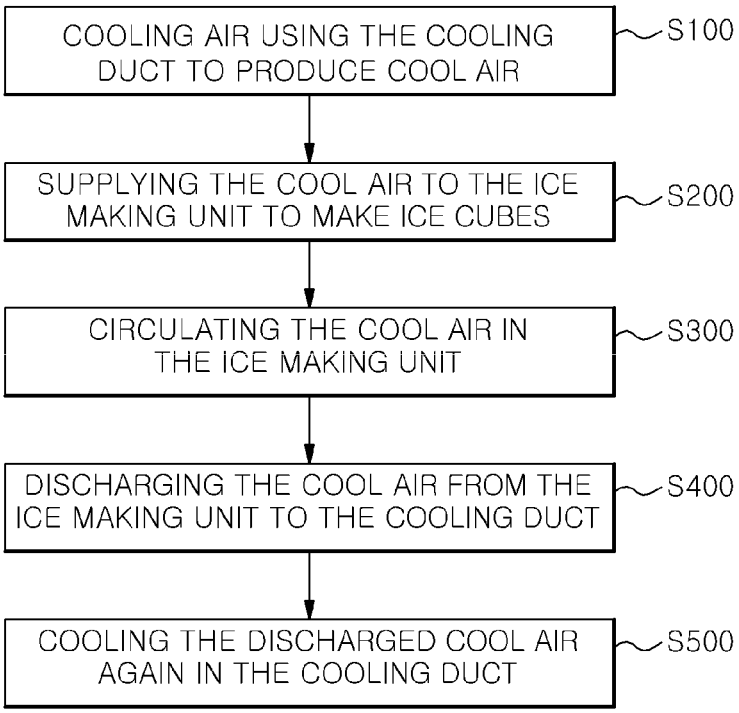
FIG. 7 is a flow diagram illustrating a method for making ice within a refrigerator unit, in accordance with one embodiment of the present disclosure.

FIG. 7 is a flow diagram illustrating a method of making ice in a refrigerator unit, in accordance with one embodiment of the present disclosure.

As shown in FIG. 7, the ice making method for the refrigerator unit may include: a step of cooling air using a cooling duct so as to produce cold air (S100); a step of supplying the cold air to the ice making unit to make ice cubes (S200); a step of circulating the cold air in the ice making unit (S300); a step of discharging the cold air from the ice making unit to the cooling duct (S400); and a step of cooling the discharged cold air again in the cooling duct (S500).

In the step of cooling air using the cooling duct so as to produce cold air (S100), air is cooled to become cold air by making the air flow through the cooling duct on which the evaporation coil is wound. In this case, the air inside the cooling duct flows through the cooling line for a predetermined period of time while losing heat by the refrigerant flowing in the evaporation coil. In that manner, the air discharged from the cooling line can be cooled to a predetermined temperature (for example, 14 degrees Fahrenheit below zero or lower) at which the cold air can efficiently make ice cubes.

In the step of supplying the cold air to the ice making unit so as to make ice cubes (S200), the cold air cooled in the cooling duct is supplied to the ice making space of the ice making unit through the inlet hole of the ice making unit. Here, the cold air supplied to the ice making space circulates in the ice making space by the operation of the circulation fan, and can freeze water inside the ice making space, thereby making ice cubes.

In the step of circulating the cold air in the ice making unit (S300), the cold air inside the ice making unit is partially guided to a position above the ice maker, and a remaining part of the cold air is guided to a position below the ice maker.

In the step of discharging the cold air from the ice making unit to the cooling duct (S400), the cold air is discharged from the ice making space into the cooling duct through the outlet hole of the ice making unit.

In the step of cooling the discharged cold air again in the cooling duct (S500), the cold air discharged into the cooling duct flows through the cooling line of the cooling duct for a predetermined period of time, thereby being cooled to a predetermined temperature or lower at which the cold air can freeze water to make ice cubes.

The foregoing description, for purpose of explanation, has been described with reference to specific embodiments of an ice maker and a method for deodorizing the same. However, the illustrative discussions above are not intended to be exhaustive or to limit the invention to the precise forms disclosed. It should be construed that the present invention has the widest range in compliance with the basic idea disclosed in the invention. Many modifications and variations are possible in view of the above teachings. Although it is possible for those skilled in the art to combine and substitute the disclosed embodiments to embody the other types that are not specifically disclosed in the invention, they do not depart from the scope of the present invention as well. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice making system for a refrigerator, the ice making system comprising:

an ice making unit that makes ice cubes;

a cold air generator that cools air inside a cooling duct so as to produce cold air;

a cold air circulation unit that supplies the cold air from the cold air generator to the ice making unit and discharges the cold air from the ice making unit to the cold air generator; and a cold air guiding unit that circulates the cold air inside the ice making unit, wherein the cold air guiding unit comprises:

a main guide that introduces the cold air from the cooling duct into the cold air guiding unit;

a first sub-guide that extends upward from the main guide so as to guide the cold air upward to a position above an ice maker of the ice making unit; and a second sub-guide that extends downward from the main guide so as to guide the cold air downward to a position below the ice maker of the ice making unit.

2. The ice making system for the refrigerator according to claim 1, wherein the cold air generator comprises:

the cooling duct through which the air flows;

an evaporation coil wound around the cooling duct such that the air is cooled by a heat exchanging operation between the air and a refrigerant;

a compressor that compresses the refrigerant discharged from the evaporation coil so as to change the refrigerant to a high temperature and high pressure gas refrigerant;

a condenser that condenses the gas refrigerant so as to change the gas refrigerant to a high pressure liquid refrigerant; and an expansion valve that performs adiabatic expansion of the liquid refrigerant and supplies the refrigerant to the evaporation coil.

3. The ice making system for the refrigerator according to claim 1, wherein the ice making unit comprises:

an ice making cabinet defining an ice making space;

the ice maker making the ice cubes using the cold air; and an ice bank storing the ice cubes.

4. The ice making system for the refrigerator according to claim 1, wherein the cold air circulation unit comprises:

an inlet hole provided on an upper part of the ice making unit such that the cold air flows from the cooling duct into the ice making unit;

an outlet hole provided on a lower part of the ice making unit such that the cold air is discharged from the ice making unit into the cooling duct; and a circulation fan that circulates the cold air from the inlet hole to the outlet hole.

5. The ice making system for the refrigerator according to claim 1, wherein:

the cooling duct is provided in a refrigerator body, and the ice making unit is provided on a refrigeration compartment door of the refrigerator, and the cooling duct connects with the ice making unit when the refrigeration compartment door is closed.

6. The ice making system for the refrigerator according to claim 2, wherein the evaporation coil functions as an evaporator of a refrigeration cycle, and cools the cooling duct through heat conduction.

7. An ice making method for a refrigerator, the method comprising:

cooling air using a cooling duct so as to produce cold air;

supplying the cold air to an ice making unit so as to make ice cubes;

circulating the cold air in the ice making unit;

discharging the cold air from the ice making unit to the cooling duct; and cooling the discharged cold air again in the cooling duct, wherein said circulating the cold air in the ice making unit further comprises:

guiding the cold air to a position above an ice maker of the ice making unit and to a position below the ice maker.

8. The ice making method of claim 7, further comprising:

providing a main guide in a cold air guiding unit configured to introduce the cold air from the cooling duct into the cold air guiding unit, wherein the cold air guiding unit is configured to circulate the cold air in the ice making unit;

providing a first sub-guide that extends upward from the main guide so as to guide the cold air upward to a position above an ice maker of the ice making unit; and providing a second sub-guide that extends downward from the main guide so as to guide the cold air downward to a position below the ice maker of the ice making unit.

9. The ice making method for the refrigerator according to claim 7, wherein the cooling of the air using the cooling duct so as to produce the cold air further comprises:

circulating the air through a cooling line of the cooling duct for a predetermined period of time, thereby cooling the air to a predetermined temperature or lower and producing the cold air.

10. The ice making method for the refrigerator according to claim 7, further comprising:

circulating air from the cooling duct to the ice making unit via an inlet hole provided on an upper part of the ice making unit;

discharging air from the ice making unit into the cooling duct via an outlet hole provided on a lower part of the ice making unit; and circulating the cold air from the inlet hole to the outlet hole in the ice making unit.

11. The ice making method for the refrigerator according to claim 7, further comprising:

providing the cooling duct in a refrigerator body;

providing the ice making unit on a refrigeration compartment door; and connecting the cooling duct with the ice making unit when the refrigeration compartment door is closed.

12. A refrigerator, comprising:

a freezer compartment located within a main body of the refrigerator;

a refrigeration compartment located within the main body of the refrigerator, wherein the freezer compartment is located below the refrigeration compartment;

an ice making unit that makes ice cubes;

a cold air generator that cools air inside a cooling duct so as to produce cold air;

a cold air circulation unit that supplies the cold air from the cold air generator to the ice making unit and discharges the cold air from the ice making unit to the cold air generator; and a cold air guiding unit that circulates the cold air inside the ice making unit, wherein the cold air guiding unit comprises:

a main guide that introduces the cold air from the cooling duct into the cold air guiding unit;

a first sub-guide that extends upward from the main guide so as to guide the cold air upward to a position above an ice maker of the ice making unit; and a second sub-guide that extends downward from the main guide so as to guide the cold air downward to a position below the ice maker of the ice making unit.

13. The refrigerator according to claim 12, wherein the cold air generator includes:

the cooling duct through which the air flows;

an evaporation coil wound around the cooling duct such that the air is cooled by a heat exchanging operation between the air and a refrigerant;

a compressor that compresses the refrigerant discharged from the evaporation coil so as to change the refrigerant to a high temperature and high pressure gas refrigerant;

a condenser that condenses the gas refrigerant so as to change the gas refrigerant to a high pressure liquid refrigerant; and an expansion valve that performs adiabatic expansion of the liquid refrigerant and supplies the refrigerant to the evaporation coil.

14. The refrigerator according to claim 13, wherein the evaporation coil functions as an evaporator of a refrigeration cycle, and cools the cooling duct through heat conduction.

15. The refrigerator according to claim 12, wherein the ice making unit comprises:

an ice making cabinet defining an ice making space;

the ice maker making the ice cubes using the cold air; and an ice bank storing the ice cubes.

16. The refrigerator according to claim 12, wherein the cold air circulation unit comprises:

an inlet hole provided on an upper part of the ice making unit such that the cold air flows from the cooling duct into the ice making unit;

an outlet hole provided on a lower part of the ice making unit such that the cold air is discharged from the ice making unit into the cooling duct; and a circulation fan that circulates the cold air from the inlet hole to the outlet hole.

17. The refrigerator according to claim 12, wherein:

the cooling duct is provided in a refrigerator body, and the ice making unit is provided on a refrigeration compartment door of the refrigerator, and the cooling duct connects with the ice making unit when the refrigeration compartment door is closed.

* * * * *